United States Patent [19]

Hoppe et al.

[11] Patent Number: 4,756,624

[45] Date of Patent: Jul. 12, 1988

[54] CIRCULATION MIXER FOR BULK MATERIAL

[75] Inventors: Hans Hoppe, Vogt; Reinhard Koppers, Bergatreute, both of Fed. Rep. of Germany

[73] Assignee: Waeschle Maschinenfabrik GmbH, Ravensburg, Fed. Rep. of Germany

[21] Appl. No.: 63,203

[22] Filed: Jun. 17, 1987

[30] Foreign Application Priority Data

Jun. 20, 1986 [DE] Fed. Rep. of Germany ..... 3620749

[51] Int. Cl.[4] ..... B01F 13/02

[52] U.S. Cl. ..... 366/101; 366/341

[58] Field of Search ..... 366/101, 102, 107, 3, 366/9, 341, 336, 340, 103, 104, 106, 10, 5, 11

[56] References Cited

U.S. PATENT DOCUMENTS

| | | | |
|---|---|---|---|
| 3,871,626 | 3/1975 | Wohlfarth | 366/107 |
| 4,194,845 | 3/1980 | Krambrock | 366/101 |
| 4,285,602 | 8/1981 | Hagerty | 366/341 |
| 4,383,766 | 5/1983 | Eriksson | 366/106 |
| 4,412,748 | 11/1983 | Wohnhas | 366/341 |
| 4,553,849 | 11/1985 | Goins | 366/341 |
| 4,591,075 | 5/1986 | Eriksson | 366/106 |

*Primary Examiner*—Robert W. Jenkins

*Attorney, Agent, or Firm*—Henry M. Feiereisen

[57] ABSTRACT

A circulation mixer for bulk material includes a container with funnel-shaped bottom to which a cellular wheel sluice is attached. The sluice is provided with inlet ports for bulk material as well as outlet ports communicating with pertaining riser pipes and includes a cellular rotor which conveys bulk material introduced through the inlet ports to the outlet ports for returning bulk material via the riser pipes to the upper part of the container. For pneumatically raising the bulk material through the riser pipes, air is injected through further ports which are arranged opposite the outlet ports and serve also as discharge ports for bulk material.

11 Claims, 4 Drawing Sheets

CIRCULATION MIXER FOR BULK MATERIAL

BACKGROUND OF THE INVENTION

The present invention refers to a circulation mixer for bulk material, and in particular to a circulation mixer with at least one riser pipe accommodated in a container with funnel-shaped bottom part for pneumatically conveying the bulk material from the bottom part back to the upper section of the container.

The use of such circulation mixers for freely flowing bulk material is known. The riser pipe extends centrally within the container with its lower opening being e.g. at the same level as the outlet opening of the container. The diameter of the riser pipe is selected in such a way that an annular gap is defined between the container wall and the lower opening of the riser pipe so as to allow the bulk material to flow into the space below the opening of the riser pipe. Air is injected through the outlet for conveying the bulk material from the space below the riser pipe through the latter to the upper section of the container and thus provides the circulation of the bulk material.

A circulation mixer of this kind has the drawback that it is not suitable for bulk material which does not freely flow like e.g. powdery or dusty bulk material. When using such more or less cohesive bulk material, bridges are formed in the narrow cross sectional areas, in particular in the annular gap between the lower opening of the riser pipe and the container wall. In addition, lump-like accumulation of material is encountered in the space below the opening of the riser pipes resulting in malfunction of the circulation mixer because the aggregated material cannot be conveyed or can be conveyed only at great expenditure back through the riser pipe to the upper section of the container.

A proposal to enlarge the cross section of the annular gap in order to prevent a formation of bridges is not feasible since the annular gap serves simultaneously as seal for the circulating air so as to make sure that the air is solely guided through the riser pipe and thus the cross sectional area of the annular gap must be kept within narrow limits.

SUMMARY OF THE INVENTION

It is thus a principal object of the present invention to provide an improved circulation mixer obviating the afore-stated drawbacks.

This object and others which will become apparent hereinafter are attained in accordance with the present invention by attaching to the bottom part of the container a cellular wheel sluice which includes a cellular rotor rotatable about a vertical shaft extending in coincidence with the longitudinal axis of the container and conveying bulk material from at least one inlet port to at least one outlet port which is in communication with a riser pipe.

Air is introduced to the sluice via at least one further port opposite to the outlet port so as to pneumatically convey bulk material through the riser pipe. Advantageously, this further port is also used for discharging bulk material when being in a homogenous state.

The circulation mixer according to the invention allows the provision of considerable cross sections in the bottom area so that the formation of bridges of bulk material is practically prevented. Moreover, by providing a cellular rotor or star-shaped wheel, defined quantities of bulk material are conveyed to the riser pipe so that the quantity and pressure of injected air can be adjusted thereby guaranteeing a return of bulk material portion to the upper part of the container.

According to the teachings of the present invention, the sluice may be provided with a plurality of inlet ports of varying cross section. This feature attains an improved homogeneity of the bulk material since different quantities of bulk material are circulated through the varying cross sectional areas of the inlet ports.

Advantageously, a deflector cone is located within the container at a distance to the cellular wheel sluice with its tip upwardly directed and defined by a longitudinal axis coinciding with the longitudinal axis of the container. The deflector cone prevents a segregation of the bulk material fraction according to their density. Preferably, the deflector has a base diameter which corresponds substantially to the diameter of the cellular wheel sluice.

BRIEF DESCRIPTION OF THE DRAWING

The above and other objects, features and advantages of the present invention will now be described in more detail with reference to the accompanying drawing in which.

DESCRIPTION OF PREFERRED EMBODIMENTS

Figure 1:
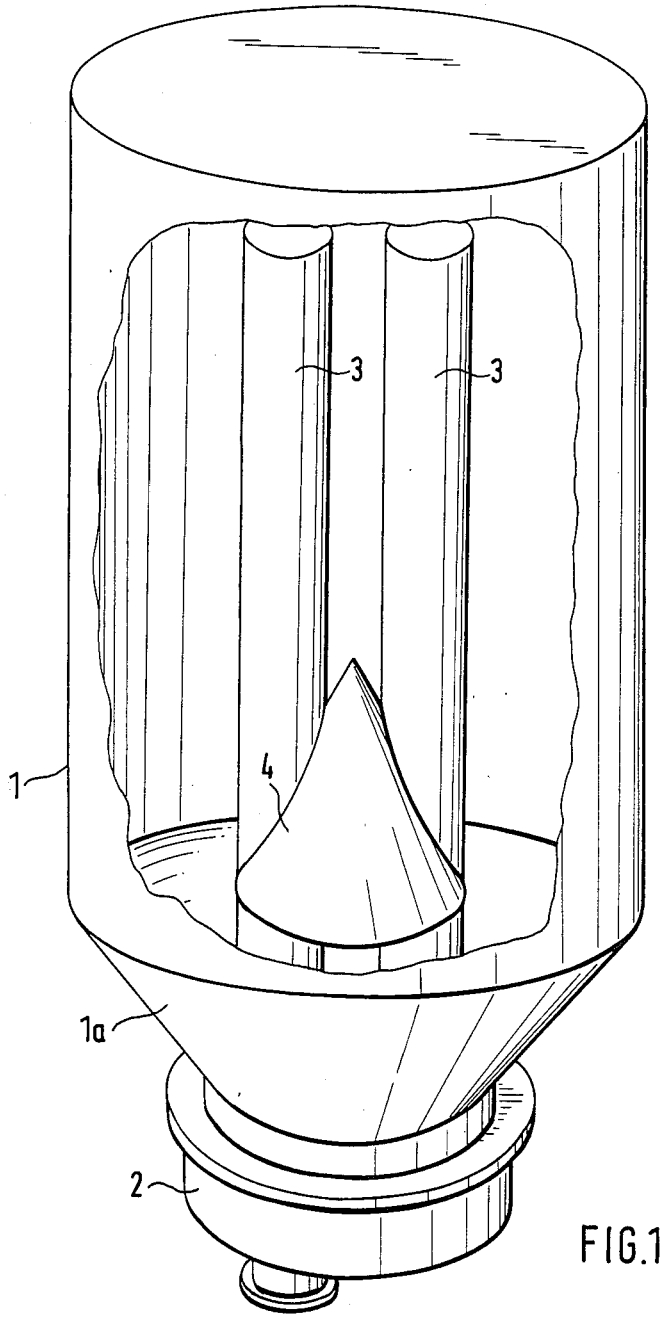
FIG. 1 is a perspective illustration of one embodiment of a circulation mixer according to the invention with parts thereof broken away to show its interior.

In the drawing, there is shown one embodiment of a circulation mixer for bulk material in accordance with the present invention. The circulation mixer includes a cylindrical container 1 with funnel-shaped or conical bottom part 1*a*. Attached to the conical bottom 1*a* is a cellular wheel sluice generally indicated by reference numeral 2. The cellular wheel sluice 2 includes a housing 2*f* which accommodates a star-shaped wheel or cellular rotor 2*a* defining a plurality of cells or compartments as shown in FIG. 3*b*. The cellular rotor 2*a* is connected to a vertical shaft 2*b* which centrally traverses the housing 2*f* and extends in direction of the longitudinal axis of the container 1. The shaft 2*b* is suitably connected to a not shown motor so as to rotate the rotor 2*a* in a direction as indicated by the arrow. At its side facing the conical bottom part 1*a*, the housing 2*f* is provided with two inlet ports 2*c* (see FIG. 4) through which the bulk material is introduced into the rotor 2*a*. As especially indicated in FIG. 3*a*, the inlet ports 2*c* are preferably of varying cross section for attaining an improved homogeneity of the bulk material within the container 1.

Figure 2:
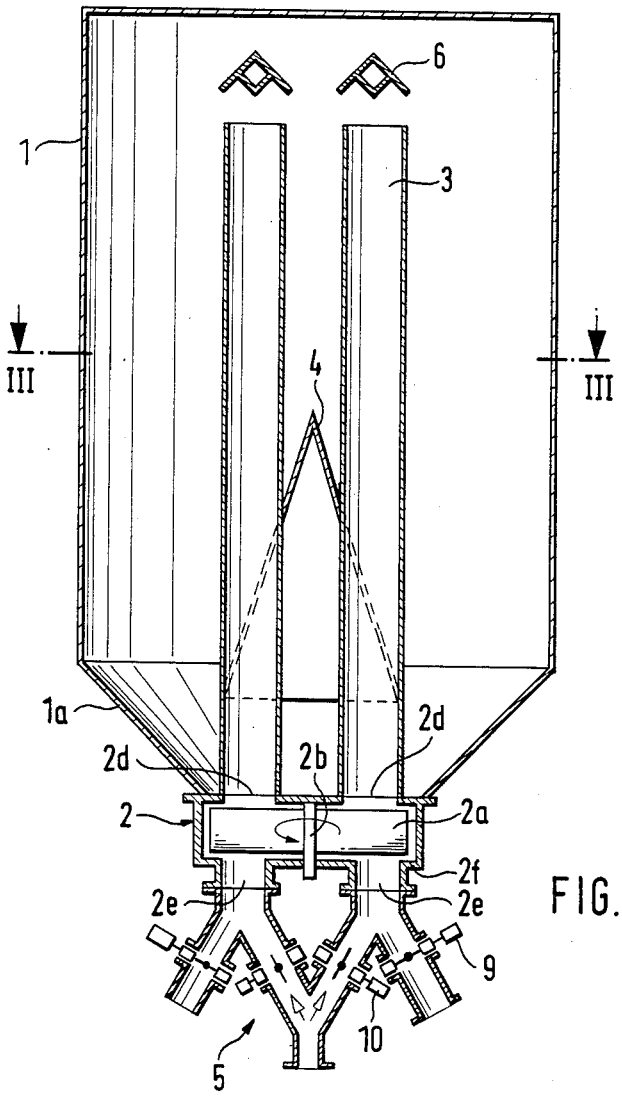
FIG. 2 is a longitudinal section of the circulation mixer along the line II—II in FIG. 3*a;*
Figure 3A:
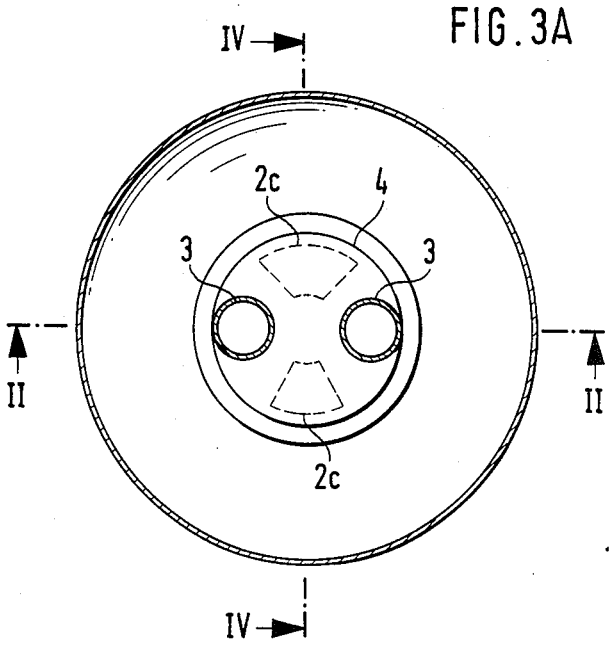
FIG. 3*a* is a cross section of the circulation mixer along the line III—III in FIG. 2.
Figure 3B:
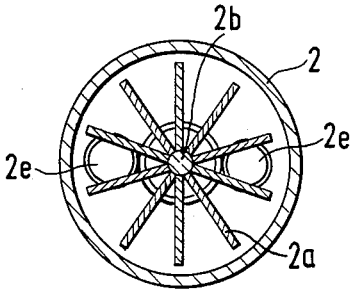
FIG. 3*b* is a cross sectional view through the cellular rotor of the circulation mixer.

As can be seen from FIGS. 2 and 3*a*, the housing 2*f* is further provided with outlet ports 2*d* which are circumferentially spaced from the inlet ports 2*c* preferably by 90°. Extending from each outlet port 2*d* is an axial riser pipe 3 which projects into the interior of the container 1 along a major portion thereof and is provided for circulating the bulk material. In the nonlimiting example as shown in the drawing, two riser pipes 3 are illustrated. It should be noted, however, that any number of inlet ports 2c and corresponding outlet ports 2d with pertaining riser pipes 3 is suitable.

Opposite to the outlet ports 2d and thus at its side remote to the bottom part 1a, the housing 2f of the cellular wheel sluice 2 is provided with ports 2e for allowing injection of air and discharge of bulk material. The ports 2e are part of a pipe system schematically illustrated and generally indicated by reference numeral 5. The pipe system 5 includes a plurality of manifolds and gate valves to selectively allow through suitable control devices (not shown) an injection of circulating air and discharge of bulk material from the container 1 after homogeneity of the bulk material is obtained. In the nonlimiting example of the circulation mixer as shown in the drawing, gate valves 9 are closed so that no bulk material is discharged while gate valves 10 are open to allow introduction of air the flow of which is indicated by arrow 11.

Located at a distance to the cellular wheel sluice 2 within the container 1 is a cone-shaped deflector 4 whose a longitudinal axis coincides with the longitudinal axis of the container 1 and which is disposed with its tip pointing upwardly. The deflector 4 is traversed by the riser pipes 3 and has a base diameter which corresponds substantially to the diameter of the cellular wheel sluice 2. The deflector 4 acts as a displacement element for enhancing the supply of bulk material to the cellular wheel sluice 2 and for providing a bulk material flow essentially in the separation layer between the fractions of different particle size or different density.

In order to provide an essentially uniform distribution of the returned bulk material, the circulation mixer according to the invention is provided with further cone-shaped deflectors 6 arranged at a distance to the upper open end of the riser pipes 3 as shown e.g. in FIG. 2.

Figure 4:
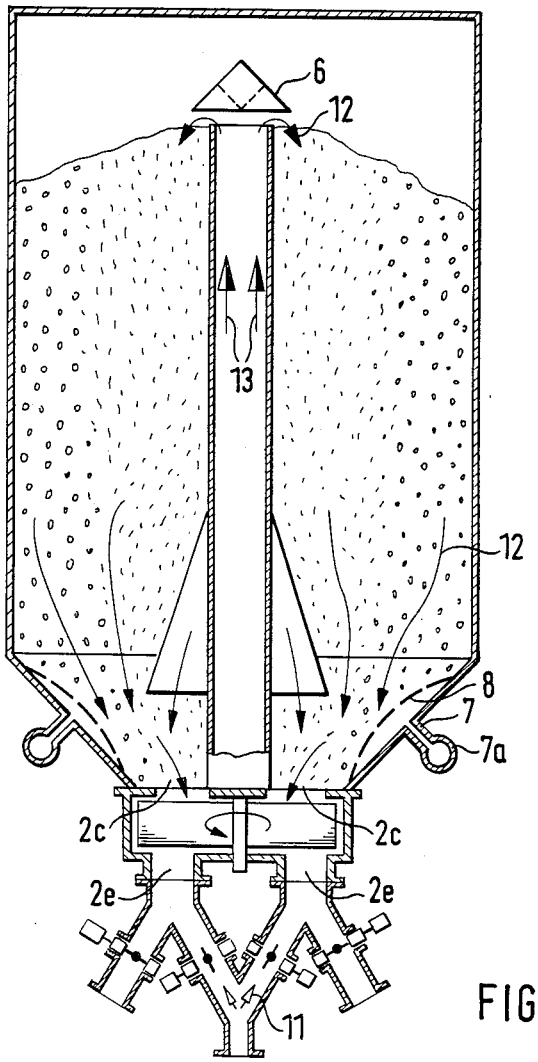
FIG. 4 is a longitudinal section of the circulation mixer along the line IV—IV in FIG. 3*a;*

In FIG. 4 a longitudinal sectional view of the circulating mixer is shown in which the flow direction of the various fluids through the container 1 is illustrated by various arrows. Accordingly, the flow of the bulk material is indicated by black arrows 12 while the black and white arrows 13 represent the flow direction of the circulated air loaded with bulk material in the riser pipe 3.

During operation, the bulk material once fed through a suitable opening of the container 1 enters through the ports 2c into the cellular wheel sluice 2. Upon rotation of the rotor 2a, the bulk material is shifted to the outlet ports 2d at defined quantities and is entrained by the air upwards through the riser pipes 3. The air is supplied through the ports 2e by e.g. a blower (not shown) which is suitably connected to the pipe system 5. The air loaded with bulk material raises through the riser pipes 3 until exiting through the upper end thereof and is deflected by the deflectors 6 in essentially uniform distribution. A segregating e.g. into to particles fractions is at least partly compensated by the deflector 4.

In order to further facilitate the discharge of bulk material, the circulation mixer according to the invention may be equipped with auxiliary discharge devices. In the nonlimiting example of the present invention, this auxiliary discharge device includes ventilating nozzles 7 connected to the bottom part la and an elastic fabric 8 lining the inner surface of the bottom part 1a. The ventilating nozzles 7 which are supplied through a circular pipeline 7a inject air towards the fabric 8 which is bulged outwardly so as to force the bulk material indirection to the inlet ports 2c (FIG. 4). Instead of the shown discharge device, other suitable means may be utilized like e.g. vibrators, introduction of blasts of compressed air possibly in connection with an elastic lining of the inner surface of the bottom part 1a.

While the invention has been illustrated and described as embodied in a Circulation Mixer for Bulk Material, it is not intended to be limited to the details shown since various modifications and structural changes may be made without departing in any way from the spirit of my present invention.

What is claimed as new and desired to be protected by Letters Patent is set forth in the appended claims:

1. A circulation mixer for bulk material, comprising:

a container defining a longitudinal axis and having a lower part and an upper part;

riser means accommodated within said container in direction of said axis for guiding the bulk material from said lower part to said upper part; and sluice means attached to said lower part of said container and including inlet means for allowing introduction of bulk material from said container, outlet means communicating with said riser means, port means cooperating with said outlet means for allowing introduction of air, and a cellular rotor for conveying bulk material introduced through said inlet means to said outlet means so that bulk material is pneumatically returnable from said lower part of said container via said riser means to said upper part of said container.

2. A mixer as defined in claim 1 wherein said rotor is rotatable about a shaft extending vertically in coincidence with said longitudinal axis of said container.

3. A mixer as defined in claim 1 wherein said port means are arranged opposite to said outlet means and are additionally provided for allowing discharge of bulk material.

4. A mixer as defined in claim 1 wherein said inlet means is a plurality of inlet ports of varying cross section.

5. A mixer as defined in claim 1 wherein said sluice means has a housing, said inlet means and said outlet means being arranged on one side of said housing and spaced from each other about the circumference of said housing and said port means being arranged at the other side of said housing.

6. A mixer as defined in claim 1, and further comprising a cone-shaped deflector arranged within said container above said sluice means and disposed with its tip facing upwardly, said riser means traversing said deflector.

7. A mixer as defined in claim 6 wherein said deflector defines a longitudinal axis coinciding with said longitudinal axis of said container and has a base diameter substantially corresponding to the diameter of said sluice means.

8. A mixer as defined in claim 1, and further comprising auxiliary means connected to said lower part of said container for facilitating discharge of bulk material.

9. A mixer as defined in claim 8 wherein said auxiliary means includes a plurality of ventilating nozzles connected to said lower part of said container and an elastic fabric lining said lower part and acted upon by air injected through said ventilating nozzles.

10. A mixer as defined in claim 1 wherein said lower part of said container is funnel-shaped.

11. A mixer as defined in claim 1 wherein said riser means includes at least one riser pipe.

* * * * *